US011950753B2

(12) United States Patent
Zhu et al.

(10) Patent No.: US 11,950,753 B2
(45) Date of Patent: Apr. 9, 2024

(54) METHOD AND SYSTEM FOR REMINDING REPLACEMENT OF FILTER OF VACUUM CLEANER AND VACUUM CLEANER

(71) Applicant: TINECO INTELLIGENT TECHNOLOGY CO., LTD., Suzhou (CN)

(72) Inventors: Tao Zhu, Suzhou (CN); Wei Xu, Suzhou (CN); Fan Fan, Suzhou (CN)

(73) Assignee: TINECO INTELLIGENT TECHNOLOGY CO., LTD., Suzhou (CN)

( * ) Notice: Subject to any disclaimer, the term of this patent is extended or adjusted under 35 U.S.C. 154(b) by 365 days.

(21) Appl. No.: 17/295,023

(22) PCT Filed: Sep. 20, 2019

(86) PCT No.: PCT/CN2019/107031
§ 371 (c)(1),
(2) Date: May 18, 2021

(87) PCT Pub. No.: WO2020/114042
PCT Pub. Date: Jun. 11, 2020

(65) Prior Publication Data

US 2021/0393095 A1 Dec. 23, 2021

(30) Foreign Application Priority Data

Dec. 3, 2018 (CN) ..... 201811465516.8

(51) Int. Cl.
*A47L 9/19* (2006.01)
*A47L 9/12* (2006.01)
*A47L 9/28* (2006.01)

(52) U.S. Cl.
CPC ..... *A47L 9/19* (2013.01); *A47L 9/12* (2013.01); *A47L 9/2831* (2013.01); *A47L 9/2842* (2013.01); *A47L 9/2857* (2013.01)

(58) Field of Classification Search
CPC . A47L 9/19; A47L 9/12; A47L 9/2831; A47L 9/2842; A47L 9/2857; A47L 9/2889; A47L 9/1666; A47L 9/2805
See application file for complete search history.

(56) References Cited

U.S. PATENT DOCUMENTS

2014/0312813 A1* 10/2014 Murchie ..... H02P 6/34 318/400.03
2016/0256026 A1* 9/2016 Kuperus ..... A47L 9/19

FOREIGN PATENT DOCUMENTS

CN 104833050 A 8/2015
CN 104958047 A 10/2015
(Continued)

OTHER PUBLICATIONS

WO 2012010493 (Year: 2012).*
(Continued)

*Primary Examiner* — Alexander Markoff
(74) *Attorney, Agent, or Firm* — Maschoff Brennan

(57) ABSTRACT

The present disclosure discloses a method for reminding a replacement of a filter of a vacuum cleaner, including: obtaining a rotating speed difference of a motor within a set time interval; comparing, according to a working parameter of the vacuum cleaner, the rotating speed difference with a preset rotating speed difference threshold, to obtain a comparison result; and determining whether to remind a user to replace the filter according to the comparison result. With the method provided by the present disclosure, the vacuum cleaner may timely and automatically remind the user to replace the filter during the use of the vacuum cleaner,
(Continued)

thereby reducing power loss, maintaining the normal use of the vacuum cleaner, and prolonging the service life of the motor.

20 Claims, 3 Drawing Sheets

(56) References Cited

FOREIGN PATENT DOCUMENTS

| | | | |
|---|---|---|---|
| CN | 205026871 | U | 2/2016 |
| CN | 107014633 | A | 8/2017 |
| CN | 206431797 | U | 8/2017 |
| CN | 108079701 | A | 5/2018 |
| CN | 207365221 | U | 5/2018 |
| CN | 108488992 | A | 9/2018 |
| DE | 10-2008-019908 | A | 10/2009 |
| DE | 102008019908 | A1 | 10/2009 |
| IN | 109124481 | A | 1/2019 |
| JP | 2001029722 | A | 2/2001 |

OTHER PUBLICATIONS

DE 102008019908 (Year: 2008).*
EP 2946711 A1 (Year: 2015).*
DE 102013104996 A1 (Year: 2014).*
Chinese Office Action dated Sep. 1, 2021 as received in application No. 201811465516.8.
Australian Examination Report dated May 23, 2022 as received in application No. 2019394434.
Chinese Office Action dated Jan. 25, 2021 as received in application No. 201811465516.8.
CN Office Action in corresponding application No. 201811465516.8 dated Jan. 25, 2021.
Australian Examination Report dated Sep. 28, 2022 as received in application No. 2019394434.

* cited by examiner

METHOD AND SYSTEM FOR REMINDING REPLACEMENT OF FILTER OF VACUUM CLEANER AND VACUUM CLEANER

TECHNICAL FIELD

The present disclosure relates to the technical field of vacuum cleaners, and in particular to a method and a system for reminding the replacement of a filter of a vacuum cleaner and a vacuum cleaner.

BACKGROUND

With the development of science and technology and the improvement of people's living standards, vacuum cleaners have become the main cleaning tool. Vacuum cleaners may be divided into vertical structures, horizontal structures and portable structures. A vacuum cleaner relies on a motor to drive an impeller to rotate at a high rotating speed to generate negative pressure in a sealed space, thereby sucking debris such as dust into a dust collection apparatus to achieve the purpose of cleaning.

However, when the vacuum cleaner working for a long time, dust accumulates on a filter of the vacuum cleaner, which easily causes the filter to be blocked. The accumulation of dust causes the ventilation effect of the filter to decrease. In order to maintain the ventilation effect of the vacuum cleaner, the rotating speed of the motor needs to increase. The increase in the rotating speed of the motor inevitably increases the power of the motor, and the increase in the power of the motor will produce high temperature, which causes power loss, is not conducive to the normal use of the vacuum cleaner and the motor and may also bring safety risks. In the prior art, the filter of the vacuum cleaner is artificially replaced after the vacuum cleaner is used for a set time interval, which will increase the operating burden of a user, and requires manual recording of the use status of the vacuum cleaner, thereby reducing the user experience.

Therefore, it becomes an urgent problem to be solved by those skilled in the art how the vacuum cleaner timely and automatically reminds the user to replace the filter during the use of the vacuum cleaner, so that the motor and the vacuum cleaner may be used normally and the power loss may be reduced.

SUMMARY

The present disclosure provides a method for reminding a replacement of a filter of a vacuum cleaner, to enable the vacuum cleaner to automatically remind a user to replace the filter during the use of the vacuum cleaner. The present disclosure further provides a system for reminding a replacement of a filter of a vacuum cleaner, and a vacuum cleaner.

The present disclosure provides a method for reminding a replacement of a filter of a vacuum cleaner, including:

- obtaining a rotating speed difference of a motor within a set time interval;
- comparing, according to working parameters of the vacuum cleaner, the rotating speed difference with a preset rotating speed difference threshold, to obtain a comparison result; and
- determining whether to remind a user to replace the filter according to the comparison result.

Optionally, the obtaining the rotating speed difference of the motor within the set time interval includes: feeding back, by a driving controller of the motor, rotating speed information of the motor to a controller, and processing, by the controller, the rotating speed information to obtain the rotating speed difference of the motor within the set time interval.

Optionally, the obtaining the rotating speed difference of the motor within the set time interval includes: obtaining and processing, by a driving controller of the motor, rotating speed information of the motor to obtain the rotating speed difference of the motor within the set time interval.

Optionally, a type of the motor includes at least one of the following motors: a brush motor or a brushless motor;

where, the brush motor detects the rotating speed information of the brush motor by means of a rotating speed detection circuit, and transmits the rotating speed information to the driving controller.

Optionally, the working parameter of the vacuum cleaner includes at least one of the following parameters: a constant motor power operating parameter, a non-constant motor power operating parameter, and a filter system parameter;

- where the comparing, according to the working parameter of the vacuum cleaner, the rotating speed difference with the preset rotating speed difference threshold, to obtain the comparison result includes:
- comparing, according to the constant motor power operating parameter, the rotating speed difference with the preset rotating speed difference threshold, to obtain the comparison result;
- comparing, according to the non-constant motor power operating parameter, the rotating speed difference with the preset rotating speed difference threshold, to obtain the comparison result; and
- comparing, according to the filter system parameter, the rotating speed difference with the preset rotating speed difference threshold, to obtain the comparison result.

Optionally, the comparing the rotating speed difference with the preset rotating speed difference threshold, to obtain the comparison result includes:

- when the rotating speed difference is greater than or equal to the preset rotating speed difference threshold, obtaining a first comparison result; and
- when the rotating speed difference is smaller than the preset rotating speed difference threshold, obtaining a second comparison result.

Optionally, the determining whether to remind the user to replace the filter according to the comparison result includes:

- reminding the user to replace the filter according to the first comparison result; and
- controlling the motor to continue running according to the second comparison result.

Optionally, a way of reminding the user to replace the filter at least includes:

- controlling a display to give a display reminder according to the first comparison result;
- or controlling an alarm to give a voice reminder.

Optionally, the determining whether to remind the user to replace the filter according to the comparison result includes:

- controlling the motor to stop running according to the first comparison result; and
- controlling the motor to continue running according to the second comparison result.

The present disclosure further provides a system for reminding a replacement of a filter of a vacuum cleaner, including a motor, a rotating speed detection apparatus, a controller, and a reminding apparatus; where the motor is coupled with the rotating speed detection apparatus, and the rotating speed detection apparatus is used to detect rotating speed information of the motor;

the rotating speed detection apparatus is coupled with the controller, and the controller is coupled with the reminding apparatus;

the rotating speed detection apparatus feeds back the detected rotating speed information to the controller, and the controller processes the rotating speed information to obtain a rotating speed difference of the motor within a set time interval, compares the rotating speed difference with a preset rotating speed difference threshold, and controls the reminding apparatus to remind a user to replace the filter or not according to a comparison result; and if so, the controller controls the reminding apparatus to remind the user to replace the filter.

Optionally, the motor includes: a brushless motor and a brush motor;

the brushless motor or the brush motor is respectively provided with a driving controller; the driving controller is coupled with the rotating speed detection apparatus, and is able to obtain the rotating speed information, detected by the rotating speed detection apparatus, of the brushless motor or the brush motor; and the driving controller feeds back the rotating speed information to the controller, and the controller processes the rotating speed information to obtain the rotating speed difference of the brushless motor or the brush motor within the set time interval.

Optionally, the motor includes: a brushless motor and a brush motor;

the brushless motor or the brush motor is respectively provided with a driving controller; the driving controller is coupled with the rotating speed detection apparatus, and is able to obtain the rotating speed information, detected by the rotating speed detection apparatus, of the brushless motor or the brush motor; and the driving controller processes the rotating speed information to obtain the rotating speed difference of the brushless motor or the brush motor within the set time interval.

Optionally, the brush motor is provided with a rotating speed detection circuit for detecting the rotating speed information of the brush motor.

Optionally, the brushless motor includes a constant power running motor and a non-constant power running motor.

Optionally, the reminding apparatus includes a display and an alarm;

the display is used to display filter replacement information under control of the controller to remind the user to replace the filter; and the alarm is used to play a sound under control of the controller to replace the filter.

The present disclosure further provides a vacuum cleaner, including: the above-mentioned system for reminding the replacement of the filter.

Compared with the prior art, the present disclosure has the following advantages:

the present disclosure provides a method for reminding a replacement of a filter of a vacuum cleaner, including: obtaining a rotating speed difference of a motor within a set time interval; comparing, according to a working parameter of the vacuum cleaner, the rotating speed difference with a preset rotating speed difference threshold, to obtain a comparison result; and determining whether to remind a user to replace the filter according to the comparison result. With the method provided by the present disclosure, the vacuum cleaner may timely and automatically remind the user to replace the filter during the use of the vacuum cleaner, thereby reducing power loss, maintaining the normal use of the vacuum cleaner, and prolonging the service life of the motor.

DETAILED DESCRIPTION OF EXAMPLE EMBODIMENTS

In the following description, many specific details are set forth in order to fully understand the present disclosure. However, the present disclosure may be implemented in many other ways different from those described herein, and those skilled in the art may make similar promotion without violating the connotation of the present disclosure. Therefore, the present disclosure is not limited by the specific embodiments disclosed below.

First, a method for reminding a replacement of a filter according to an embodiment of the present disclosure is applied to a filter of a vacuum cleaner. The reason why the filter needs to be replaced from the vacuum cleaner is because suction air flow generated by the starting of a motor will carry dust particles to the filter during the operation of the vacuum cleaner. As the filter continues accumulating dust, the ventilation effect of the filter is reduced. In order to maintain the ventilation effect of the vacuum cleaner, the rotating speed of the motor needs to increase. The increase in the rotating speed of the motor inevitably increases the power of the motor, and the increase in the power of the motor will produce high temperature, which is not conducive to the normal use of the vacuum cleaner and the motor. Therefore, in order to ensure the normal operation of the vacuum cleaner, the filter needs to be replaced in time, and in this embodiment, the vacuum cleaner may automatically remind the user to replace the filter.

Figure 1:
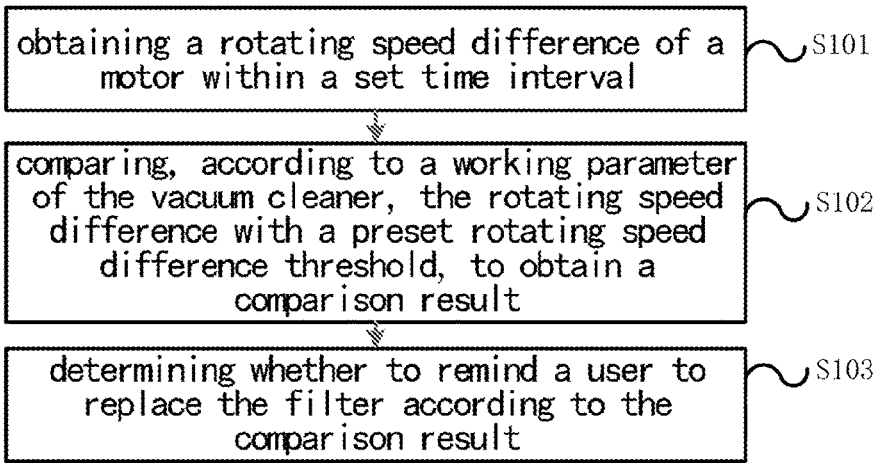
FIG. 1 is a schematic flowchart of a method for reminding a replacement of a filter of a vacuum cleaner according to an embodiment of the present disclosure.

Specifically, FIG. 1 is a schematic flowchart of a method for reminding a replacement of a filter of a vacuum cleaner according to an embodiment of the present disclosure. As shown in FIG. 1, the flow of the method for reminding the replacement of the filter of the vacuum cleaner according to the embodiment of the present disclosure includes the following steps:

at S101, obtaining a rotating speed difference of a motor within a set time interval.

At this step, it may be understood that the rotating speed difference is obtained according to a difference between a current rotating speed value and an initial rotating speed value of the motor, and the initial rotating speed value of the motor may be interpreted as being obtained when the filter is in a clean state. After the filter is used for a period of time (that is, the set time interval), a certain amount of dust will accumulate on the filter, so that the rotating speed value of the motor changes (the rotating speed increases), and then the rotating speed difference of the motor within this time interval may be obtained. Of course, in this embodiment, the time for obtaining the rotating speed difference of the motor within the set time interval is set according to the actual use of the vacuum cleaner. The set time interval may be a few hours, a few days, a week or a month.

Further, in this embodiment, a type of the motor includes at least one of the following motors: a brush motor or a brushless motor. The brush motor is a rotating motor which includes a brush apparatus and converts electrical energy into mechanical energy (electric motor) or converts mechanical energy into electrical energy (generator). The brushless motor is composed of a motor body and a driver, and is a typical mechatronic product.

Considering different types of motors, correspondingly, the obtaining the rotating speed difference of the motor within the set time interval includes: obtaining a rotating speed difference of a brush motor within a set time interval, or obtaining a rotating speed difference of a brushless motor within a set time interval.

Specifically, the obtaining the rotating speed difference of the brush motor within the set time interval includes the following two solutions:

Solution 1: the brush motor is provided with a driving controller and a rotating speed detection circuit, the rotating speed detection circuit detects rotating speed information of the brush motor and transmits the rotating speed information to the driving controller, the driving controller feeds back the rotating speed information of the brush motor to a controller, and the controller processes the rotating speed information to obtain the rotating speed difference of the brush motor within the set time interval.

Solution 2: the brush motor is provided with a driving controller and a rotating speed detection circuit, the rotating speed detection circuit detects rotating speed information of the brush motor and transmits the rotating speed information to the driving controller, and the driving controller obtains and processes the rotating speed information of the brush motor to obtain the rotating speed difference of the brush motor within the set time interval.

Correspondingly, the obtaining the rotating speed difference of the brushless motor within the set time interval includes the following two solutions:

Solution 1: the brushless motor is provided with a driving controller, the driving controller is able to feed back rotating speed information output by the brushless motor to a controller, and the controller processes the rotating speed information to obtain the rotating speed difference of the brushless motor within the set time interval.

Solution 2: the brushless motor is provided with a driving controller, and the driving controller is able to obtain and process rotating speed information of the brushless motor to obtain the rotating speed difference of the brushless motor within the set time interval.

Continuing referring to FIG. 1, at S102, comparing, according to a working parameter of the vacuum cleaner, the rotating speed difference with a preset rotating speed difference threshold, to obtain a comparison result.

At this step, the working parameter of the vacuum cleaner includes at least one of the following parameters: a constant motor power operating parameter, a non-constant motor power operating parameter, and a filter system parameter.

The constant motor power operating parameter is set when the motor is in a constant power operating mode. When the motor in the constant power operating mode is working, the rotating speed of the motor hardly changes. When the filter is in the clean state, the (initial) rotating speed value of the motor is obtained. A certain amount of dust accumulates on the filter within the set time interval, the rotating speed of the motor increases, the rotating speed value of the motor is obtained again, and the rotating speed difference of the motor within the set time interval is obtained accordingly. Of course, for motors with different operating powers, when the filter is in the clean state, the rotating speed of the motor hardly changes, and only the rotating speed value of the motor in the clean state is different.

Correspondingly, the non-constant motor power operating parameter is set when the motor is in a non-constant power operating mode. When the motor in the non-constant power operating mode is working, the rotating speed of the motor changes with a power supply voltage from time to time. In order to avoid the situation that the rotating speed difference of the motor within the set time interval may not be accurately obtained when dust accumulates, modeling between voltage and rotating speed is performed for different power supply voltages when the filter is in the clean state. Then, after a certain amount of dust accumulates on the filter within the set time interval, the rotating speed of the motor increases, and the rotating speed difference of the motor within the set time interval is obtained accordingly.

Correspondingly, the filter system parameter is set according to different filter systems of different vacuum cleaners. The different filter systems will lead to different rotating speed differences of motors. The filter system includes a filter and a filter cotton assembly, the filter is mainly arranged on the two components, and according to installation positions of the filter and the filter cotton assembly in the vacuum cleaner, in this embodiment, the filter may be a dust filter installed at a cyclone separator of the vacuum cleaner, or a filter at an air outlet of the vacuum cleaner, or a secondary filter in an air duct, or the like. Therefore, different filter systems correspond to different filter system parameters, and the obtained rotating speed differences of the corresponding motors within the set time interval are also different.

Particularly, the above constant motor power operating parameter and non-constant motor power operating parameter are mainly applicable to the brushless motor. Of course, the relevant parameters are also applicable to other types of motors. The working parameter of the vacuum cleaner may be set to obtain the rotating speed difference of the corresponding motor in the corresponding operating mode within the set time interval, and the rotating speed difference is compared with the preset rotating speed difference threshold to obtain the comparison result.

Specifically, according to the constant motor power operating parameter, the rotating speed difference is compared with the preset rotating speed difference threshold to obtain the comparison result; or according to the non-constant motor power operating parameter, the rotating speed difference is compared with the preset rotating speed difference threshold to obtain the comparison result; or according to the filter system parameter, the rotating speed difference is compared with the preset rotating speed difference threshold to obtain the comparison result.

The comparing the rotating speed difference with a preset rotating speed difference threshold to obtain a comparison result includes: when the rotating speed difference is greater than or equal to the preset rotating speed difference threshold, a first comparison result is obtained; and when the rotating speed difference is smaller than the preset rotating speed difference threshold, a second comparison result is obtained. It may be understood that the preset rotating speed difference threshold is specifically set for different vacuum cleaners and different types of motors. The rotating speed difference threshold may be obtained from many experiments or from experience, and its purpose is to remind a user to replace the filter in time while protecting the normal operation of the vacuum cleaner and the motor.

Continuing referring to FIG. 1, at S103, determining whether to remind a user to replace the filter according to the comparison result.

It may be seen from S102 that when the rotating speed difference is greater than or equal to the preset rotating speed difference threshold, the first comparison result is obtained; and further, the user is reminded to replace the filter according to the first comparison result. Hence, when the rotating speed difference is greater than or equal to the preset rotating speed difference threshold, it indicates that the filter is blocked, and the user needs to be reminded to replace the filter. Correspondingly, when the rotating speed difference is smaller than the preset rotating speed difference threshold, it indicates that the filter is not blocked, that is, the vacuum cleaner and the motor are working normally, and the user does not need to be reminded to replace the filter. After reminding the user for a certain time, such as 10*s*, if any feedback is not received from the user, the vacuum cleaner needs to start a protection program to control the motor to automatically shut down. If a feedback is received from the user, the user may replace the filter.

It may be seen from S102 that when the rotating speed difference is greater than or equal to the preset rotating speed difference threshold, the first comparison result is obtained; and further, the motor is controlled to stop running according to the first comparison result. Hence, when the rotating speed difference is greater than or equal to the preset rotating speed difference threshold, it indicates that the filter is blocked, and the motor needs to be controlled to stop running. Correspondingly, when the rotating speed difference is smaller than the preset rotating speed difference threshold, it indicates that the filter is not blocked, that is, the vacuum cleaner and the motor are working normally, and the motor does not need to be controlled to stop running. If the vacuum cleaner is severely blocked, then when the rotating speed difference is greater than or equal to the preset rotating speed difference threshold, the operation of reminding the user to replace the filter is not required, but the motor is directly controlled to stop running.

In another embodiment of the present disclosure, when the rotating speed difference is greater than or equal to the preset rotating speed difference threshold, the first comparison result is obtained; and further, according to the first comparison result, the operation of reminding the user to replace the filter is executed, indicating that the vacuum cleaner is blocked. If a user's feedback is obtained, the user may perform the operation of replacing the filter; if any user's feedback is not obtained, the vacuum cleaner may continue working, including: when the rotating speed difference is greater than or equal to the preset rotating speed difference threshold, a third comparison result is obtained; and further, according to the third comparison result, the motor is controlled to stop running, which indicates that the vacuum cleaner is severely blocked. When the rotating speed difference is smaller than or equal to the preset rotating speed difference threshold, a fourth comparison result is obtained; and further, according to the fourth comparison result, the vacuum cleaner continues reminding the user to replace the filter without performing the operation of controlling the motor to stop running.

In this embodiment, a way of reminding the user to replace the filter includes at least: according to the first comparison result, a display is controlled to give a display reminder; or an alarm is controlled to give a voice reminder. Specifically, an LED display is controlled to flash or display text, graphics, etc., to remind the user to replace the filter; or a buzzer alarm is controlled to buzz or broadcast to remind the user to replace the filter. Of course, in this embodiment, the user may also be reminded to replace the filter in other ways, and specific limitations are not given here.

It should be noted that, corresponding to the foregoing, when the brush motor is provided with a driving controller, the driving controller feeds back the rotating speed information of the brush motor to the controller, and the controller controls the display or alarm to remind the user to replace the filter. When the brush motor is provided with a driving controller, the driving controller obtains and processes the rotating speed information of the brush motor, and the driving controller controls the display or alarm to remind the user to replace the filter.

Correspondingly, when the brushless motor is provided with a driving controller, the driving controller feeds back the rotating speed information of the brushless motor to the controller, and the controller controls the display or alarm to remind the user to replace the filter. When the brushless motor is provided with a driving controller, the driving controller obtains and processes the rotating speed information of the brushless motor, and the driving controller controls the display or alarm to remind the user to replace the filter.

The embodiment of the present disclosure provides a method for reminding a replacement of a filter of a vacuum cleaner, including: obtaining a rotating speed difference of a motor within a set time interval; comparing, according to a working parameter of the vacuum cleaner, the rotating speed difference with a preset rotating speed difference threshold, to obtain a comparison result; and determining whether to remind a user to replace the filter according to the comparison result. With the method provided by the present disclosure, the vacuum cleaner may timely and automatically remind the user to replace the filter during the use of the vacuum cleaner, thereby reducing power loss, maintaining the normal use of the vacuum cleaner, and prolonging the service life of the motor.

Figure 2:
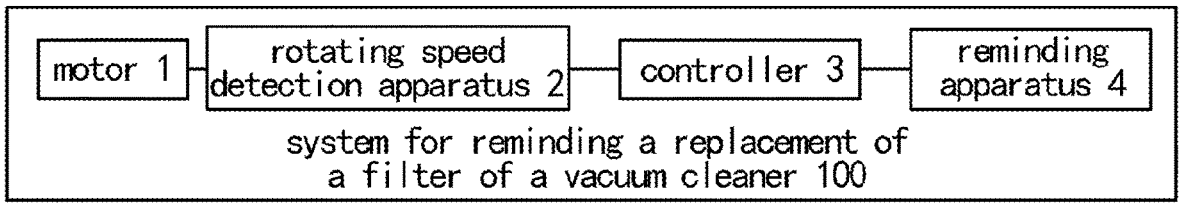
FIG. 2 is a schematic structure diagram of a system for reminding a replacement of a filter of a vacuum cleaner according to an embodiment of the present disclosure.

An embodiment of the present disclosure further provides a system 100 for reminding a replacement of a filter of a vacuum cleaner, as shown in FIG. 2, including a motor 1, a rotating speed detection apparatus 2, a controller 3, and a reminding apparatus 4.

Figure 7:
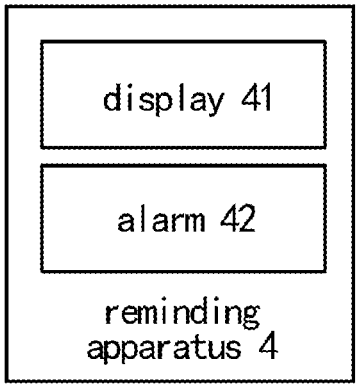
FIG. 7 is a schematic structure diagram of a reminding apparatus in a system for reminding a replacement of a filter of a vacuum cleaner according to an embodiment of the present disclosure.

The motor 1 is coupled to the rotating speed detection apparatus 2, and the rotating speed detection apparatus 2 is used to detect rotating speed information of the motor 1; the rotating speed detection apparatus 2 is coupled to the controller 3, and the controller 3 is coupled to the reminding apparatus 4; the rotating speed detection apparatus 2 feeds back the detected rotating speed information to the controller 3, and the controller 3 processes the rotating speed information to obtain a rotating speed difference of the motor 1 within a set time interval, compares the rotating speed difference with a preset rotating speed difference threshold, and controls the reminding apparatus 4 to remind a user to replace the filter or not according to a comparison result; and if so, the controller 3 controls the reminding apparatus 4 to remind the user to replace the filter. As shown in FIG. 7, the reminding apparatus 4 includes a display 41 and an alarm 42; the display 41 is used to display filter replacement information under control of the controller 3 to remind the user to replace the filter; and the alarm 42 is used to play a sound under control of the controller 3 to remind the user to replace the filter.

Figure 3:
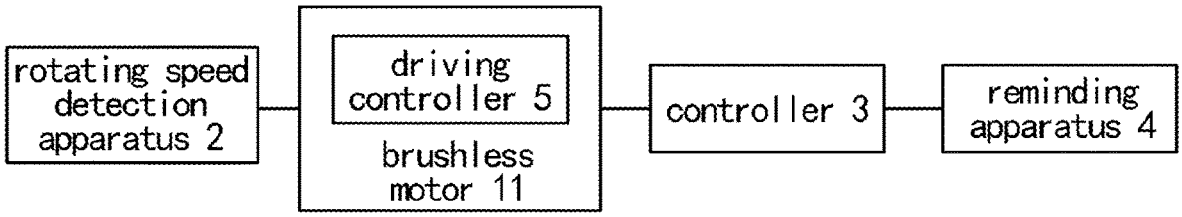
FIG. 3 is a schematic structure diagram of a brushless motor in a system for reminding a replacement of a filter of a vacuum cleaner according to an embodiment of the present disclosure.
Figure 4:
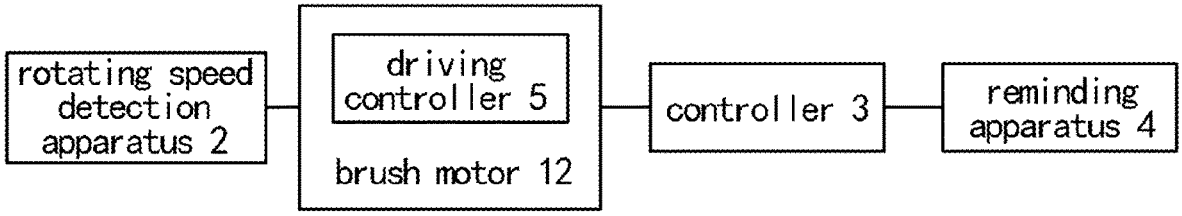
FIG. 4 is a schematic structure diagram of a brush motor in a system for reminding a replacement of a filter of a vacuum cleaner according to an embodiment of the present disclosure.

Further, in this embodiment, the motor 1 includes: a brushless motor 11 and a brush motor 12; specifically, as shown in FIGS. 3 and 4, the brushless motor 11 or the brush motor 12 is respectively provided with a driving controller 5; the driving controller 5 is coupled to the rotating speed detection apparatus 2, and may obtain the rotating speed information, detected by the rotating speed detection apparatus 2, of the brushless motor 11 or the brush motor 12; the driving controller 5 feeds back the rotating speed information to the controller 3, and the controller 3 processes the rotating speed information to obtain the rotating speed difference of the brushless motor 11 or the brush motor 12 within the set time interval. Furthermore, the controller 3 is coupled to the reminding apparatus 4 to remind the user to replace the filter.

Figure 5:
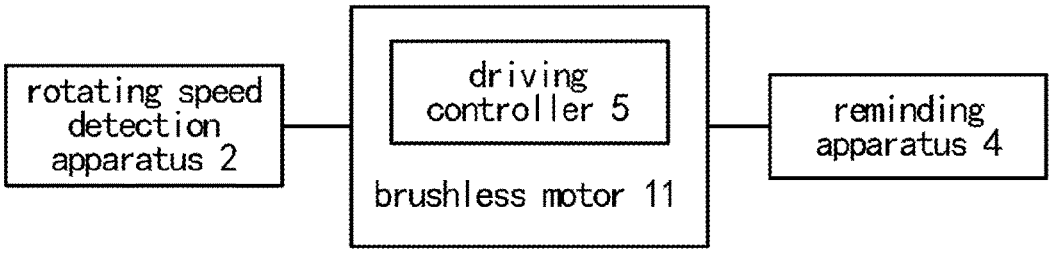
FIG. 5 is a schematic structure diagram of another brushless motor in a system for reminding a replacement of a filter of a vacuum cleaner according to an embodiment of the present disclosure.
Figure 6:
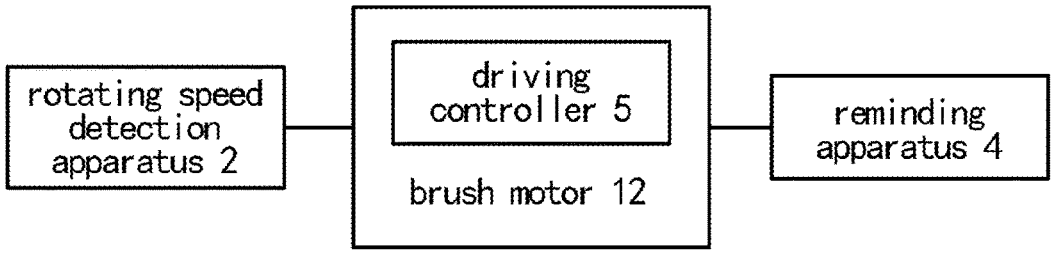
FIG. 6 is a schematic structure diagram of another brush motor in a system for reminding a replacement of a filter of a vacuum cleaner according to an embodiment of the present disclosure.

Alternatively, in this embodiment, the motor 1 includes: a brushless motor 11 and a brush motor 12; specifically, as shown in FIGS. 5 and 6, the brushless motor 11 or the brush motor 12 is respectively provided with a driving controller 5; the driving controller 5 is coupled to the rotating speed detection apparatus 2, and may obtain the rotating speed information, detected by the rotating speed detection apparatus 2, of the brushless motor 11 or the brush motor 12; and the driving controller 5 processes the rotating speed information to obtain the rotating speed difference of the brushless motor 11 or the brush motor 12 within the set time interval. Furthermore, the driving controller 5 is coupled to the reminding apparatus 4 to remind the user to replace the filter. It should be noted that the brush motor 12 is provided with a rotating speed detection circuit for detecting the rotating speed information of the brush motor 12. The brushless motor 11 includes a constant power running motor and a non-constant power running motor.

The embodiment of the present disclosure provides a system 100 for reminding a replacement of a filter of a vacuum cleaner, including a motor 1, a rotating speed detection apparatus 2, a controller 3, and a reminding apparatus 4; the motor 1 is coupled to the rotating speed detection apparatus 2, and the rotating speed detection apparatus 2 is used to detect rotating speed information of the motor 1; the rotating speed detection apparatus 2 is coupled to the controller 3, and the controller 3 is coupled to the reminding apparatus 4; the rotating speed detection apparatus 2 feeds back the detected rotating speed information to the controller 3, and the controller 3 processes the rotating speed information to obtain a rotating speed difference of the motor 1 within a set time interval, compares the rotating speed difference with a preset rotating speed difference threshold, and controls the reminding apparatus 4 to remind a user to replace the filter or not according to a comparison result. With the system provided by the present disclosure, the vacuum cleaner may timely and automatically remind the user to replace the filter during the use of the vacuum cleaner, thereby reducing power loss, maintaining the normal use of the vacuum cleaner, and prolonging the service life of the motor 1.

Figure 8:
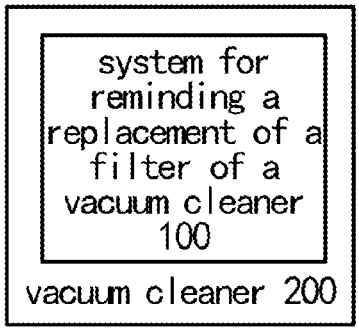
FIG. 8 is a schematic structure diagram of a vacuum cleaner according to an embodiment of the present disclosure.

An embodiment of the present disclosure further provides a vacuum cleaner 200, as shown in FIG. 8, including: the above-mentioned system 100 for reminding the replacement of the filter of the vacuum cleaner. Based on the fact that the vacuum cleaner has all the features of the system 100 for reminding the replacement of the filter of the vacuum cleaner, the vacuum cleaner may timely and automatically remind the user to replace the filter during the use of the vacuum cleaner, thereby reducing power loss, maintaining the normal use of the vacuum cleaner, and prolonging the service life of the motor 1.

The present disclosure is disclosed as above with the preferred embodiments, but is not limited thereto. Any person skilled in the art may make possible changes and modifications without departing from the spirit and scope of the present disclosure. Therefore, the protection scope of the present disclosure shall be subject to the scope defined by the claims of the present disclosure.

What is claimed is:

1. A method for reminding a replacement of a filter of a vacuum cleaner, comprising:

obtaining a rotating speed difference of a motor within a set time interval;

comparing, according to a working parameter of the vacuum cleaner, the rotating speed difference with a preset rotating speed difference threshold, to obtain a comparison result; and reminding a user to replace the filter according to the comparison result;

wherein the working parameter of the vacuum cleaner comprises: a non-constant motor power operating parameter, and the comparing, according to a working parameter of the vacuum cleaner, the rotating speed difference with a preset rotating speed difference threshold, to obtain a comparison result, comprises: comparing, according to non-constant motor power operating parameter, the rotating speed difference with the preset rotating speed difference threshold, to obtain the comparison result; and wherein the non-constant motor power operating parameter is set when the motor is in a non-constant power operating mode, when the motor in the non-constant power operating mode is working, a rotating speed of the motor changes with a power supply voltage from time to time; and a modeling between the power supply voltage and the rotating speed is performed for different power supply voltages.

2. The method for reminding the replacement of the filter of the vacuum cleaner according to claim 1, wherein, the obtaining the rotating speed difference of the motor within the set time interval, comprises:

feeding back, by a driving controller of the motor, rotating speed information of the motor to a controller, and processing, by the controller, the rotating speed information to obtain the rotating speed difference of the motor within the set time interval.

3. The method for reminding the replacement of the filter of the vacuum cleaner according to claim 1, wherein, the obtaining the rotating speed difference of the motor within the set time interval, comprises:

obtaining and processing, by a driving controller of the motor, rotating speed information of the motor to obtain the rotating speed difference of the motor within the set time interval.

4. The method for reminding the replacement of the filter of the vacuum cleaner according to claim 2, wherein, a type of the motor comprises at least one of the following motors: a brush motor or a brushless motor;

wherein, the brush motor detects the rotating speed information of the brush motor by means of a rotating speed detection circuit, and transmits the rotating speed information to the driving controller.

5. The method for reminding the replacement of the filter of the vacuum cleaner according to claim 1, wherein, the working parameter of the vacuum cleaner further comprises: a constant motor power operating parameter and a filter system parameter;

wherein, the comparing, according to the working parameter of the vacuum cleaner, the rotating speed difference with the preset rotating speed difference threshold, to obtain the comparison result, comprises:

comparing, according to the constant motor power operating parameter, the rotating speed difference with the preset rotating speed difference threshold, to obtain the comparison result;

comparing, according to the non-constant motor power operating parameter, the rotating speed difference with the preset rotating speed difference threshold, to obtain the comparison result; and comparing, according to the filter system parameter, the rotating speed difference with the preset rotating speed difference threshold, to obtain the comparison result.

6. The method for reminding the replacement of the filter of the vacuum cleaner according to claim 5, wherein, the comparing the rotating speed difference with the preset rotating speed difference threshold, to obtain the comparison result, comprises:

when the rotating speed difference is greater than or equal to the preset rotating speed difference threshold, obtaining a first comparison result; and when the rotating speed difference is smaller than the preset rotating speed difference threshold, obtaining a second comparison result.

7. The method for reminding the replacement of the filter of the vacuum cleaner according to claim 6, reminding the user to replace the filter according to the first comparison result.

8. The method for reminding the replacement of the filter of the vacuum cleaner according to claim 7, wherein, a way of reminding the user to replace the filter, at least comprises:

controlling a display to give a display reminder according to the first comparison result; or controlling an alarm to give a voice reminder.

9. The method for reminding the replacement of the filter of the vacuum cleaner according to claim 6, wherein, the reminding the user to replace the filter according to the comparison result, comprises:

controlling the motor to stop running according to the first comparison result.

10. A system for reminding a replacement of a filter of a vacuum cleaner, comprising: a motor, a rotating speed detection apparatus, a controller, and a reminding apparatus; wherein, the motor is coupled with the rotating speed detection apparatus, and the rotating speed detection apparatus is used to detect rotating speed information of the motor;

the rotating speed detection apparatus is coupled with the controller, and the controller is coupled with the reminding apparatus;

the rotating speed detection apparatus feeds back the detected rotating speed information to the controller, the controller processes the rotating speed information to obtain a rotating speed difference of the motor within a set time interval, compares the rotating speed difference with a preset rotating speed difference threshold according to a working parameter of the vacuum cleaner to obtain a comparison result, wherein, the working parameter of the vacuum cleaner comprises: a non-constant motor power operating parameter, and controls the reminding apparatus to remind a user to replace the filter or not according to the comparison result; and if so, the controller controls the reminding apparatus to remind the user to replace the filter;

wherein the rotating speed difference is compared with the preset rotating speed difference threshold according to the non-constant motor power operating parameter to obtain a comparison result;

and wherein the non-constant motor power operating parameter is set when the motor is in a non-constant power operating mode, when the motor in the non-constant power operating mode is working, a rotating speed of the motor changes with a power supply voltage from time to time; and a modeling between the power supply voltage and the rotating speed is performed for different power supply voltages.

11. The system for reminding the replacement of the filter of the vacuum cleaner according to claim 10, wherein, the motor comprises: a brushless motor and a brush motor;

the brushless motor or the brush motor is respectively provided with a driving controller; the driving controller is coupled with the rotating speed detection apparatus, and is able to obtain the rotating speed information, detected by the rotating speed detection apparatus, of the brushless motor or the brush motor; and the driving controller feeds back the rotating speed information to the controller, and the controller processes the rotating speed information to obtain the rotating speed difference of the brushless motor or the brush motor within the set time interval.

12. The system for reminding the replacement of the filter of the vacuum cleaner according to claim 10, wherein, the motor comprises: a brushless motor and a brush motor;

the brushless motor or the brush motor is respectively provided with a driving controller; the driving controller is coupled with the rotating speed detection apparatus, and is able to obtain the rotating speed information, detected by the rotating speed detection apparatus, of the brushless motor or the brush motor; and the driving controller processes the rotating speed information to obtain the rotating speed difference of the brushless motor or the brush motor within the set time interval.

13. The system for reminding the replacement of the filter of the vacuum cleaner according to claim 11, wherein, the brush motor is provided with a rotating speed detection circuit for detecting the rotating speed information of the brush motor.

14. The system for reminding the replacement of the filter of the vacuum cleaner according to claim 11, wherein, the brushless motor comprises a constant power running motor and a non-constant power running motor.

15. The system for reminding the replacement of the filter of the vacuum cleaner according to claim 10, wherein, the reminding apparatus comprises a display and an alarm;

the display is used to display filter replacement information under control of the controller to remind the user to replace the filter; and the alarm is used to play a sound under control of the controller to remind the user to replace the filter.

16. A vacuum cleaner, comprising: a motor, a rotating speed detection apparatus, a controller, and a reminding apparatus; wherein, the motor is coupled with the rotating speed detection apparatus, and the rotating speed detection apparatus is used to detect rotating speed information of the motor;

the rotating speed detection apparatus is coupled with the controller, and the controller is coupled with the reminding apparatus;

the rotating speed detection apparatus feeds back the detected rotating speed information to the controller, the controller processes the rotating speed information to obtain a rotating speed difference of the motor within a set time interval, compares the rotating speed difference with a preset rotating speed difference threshold according to a working parameter of the vacuum cleaner to obtain a comparison result, wherein, the working parameter of the vacuum cleaner comprises a non-constant motor power operating parameter, and controls the reminding apparatus to remind a user to replace the filter or not according to a comparison result; and if so, the controller controls the reminding apparatus to remind the user to replace the filter;

wherein the rotating speed difference is compared with the preset rotating speed difference threshold according to the non-constant motor power operating parameter to obtain a comparison result;

and wherein the non-constant motor power operating parameter is set when the motor is in a non-constant power operating mode, when the motor in the non-constant power operating mode is working, a rotating speed of the motor changes with a power supply voltage from time to time; and a modeling between the power supply voltage and the rotating speed is performed for different power supply voltages.

17. The method for reminding the replacement of the filter of the vacuum cleaner according to claim 3, wherein, a type of the motor comprises at least one of the following motors: a brush motor or a brushless motor;

wherein, the brush motor detects the rotating speed information of the brush motor by means of a rotating speed detection circuit, and transmits the rotating speed information to the driving controller.

18. The system for reminding the replacement of the filter of the vacuum cleaner according to claim 12, wherein, the brush motor is provided with a rotating speed detection circuit for detecting the rotating speed information of the brush motor.

19. The system for reminding the replacement of the filter of the vacuum cleaner according to claim 12, wherein, the brushless motor comprises a constant power running motor and a non-constant power running motor.

20. The method for reminding the replacement of the filter of the vacuum cleaner according to claim 1, wherein, the working parameter of the vacuum cleaner comprises a constant motor power operating parameter;

wherein, the comparing, according to the working parameter of the vacuum cleaner, the rotating speed difference with the preset rotating speed difference threshold, to obtain the comparison result, comprises:

comparing, according to the constant motor power operating parameter, the rotating speed difference with the preset rotating speed difference threshold, to obtain the comparison result.

* * * * *